US006571501B1

(12) United States Patent
Jennings

(10) Patent No.: US 6,571,501 B1
(45) Date of Patent: Jun. 3, 2003

(54) PISTOL CALIBER CONVERSION ASSEMBLY

(76) Inventor: Steve Jennings, 25163 W. Ave. Stanford, Valencia, CA (US) 91355

( * ) Notice: Subject to any disclaimer, the term of this patent is extended or adjusted under 35 U.S.C. 154(b) by 0 days.

(21) Appl. No.: 10/039,691

(22) Filed: Dec. 31, 2001

Related U.S. Application Data

(60) Provisional application No. 60/259,940, filed on Jan. 2, 2001.

(51) Int. Cl.[7] ..... F41A 17/36
(52) U.S. Cl. ..... 42/70.02; 89/199
(58) Field of Search ..... 42/70.01, 70.02; 89/199

(56) References Cited

U.S. PATENT DOCUMENTS 1,376,165 A * 4/1921 Rosebush
4,031,648 A * 6/1977 Thomas ..... 89/137
4,352,317 A * 10/1982 Wilhelm ..... 89/154
4,589,327 A * 5/1986 Smith ..... 89/148
4,974,356 A * 12/1990 Kelsey, Jr. et al. ..... 42/69.03
5,216,191 A * 6/1993 Fox ..... 42/70.05

FOREIGN PATENT DOCUMENTS

GB 306082 * 4/1930 ..... 42/70.02

* cited by examiner

*Primary Examiner*—Stephen M. Johnson
(74) *Attorney, Agent, or Firm*—Roger A. Marrs

(57) ABSTRACT

A pistol caliber conversion assembly having a slide assembly housing components of lightweight characteristics so as to accept and permit an interchange of a variety of caliber ammunition. The assembly includes a rail and groove arrangement for slidably mounting a slide housing onto the frame and a recoil mechanism for urging a barrel into a reset position after firing. An open lock mechanism selectively engages the slide housing with the frame and sets to an automatic open position upon ejecting of a last round from the ammunition chamber. The critical selection of high strength-to-weight ratio materials permits machining away of excess materials to reduce weight while maintaining sufficient hardness and mass to handle firing loads.

2 Claims, 4 Drawing Sheets

27
21
26
20
14
12
28
17
45
31
32
13
37
33
36
34
35
23
40
42
41
43
22
11
25
10
47
46
44
24
16
12
14
15
13
11
48

FIG. 3
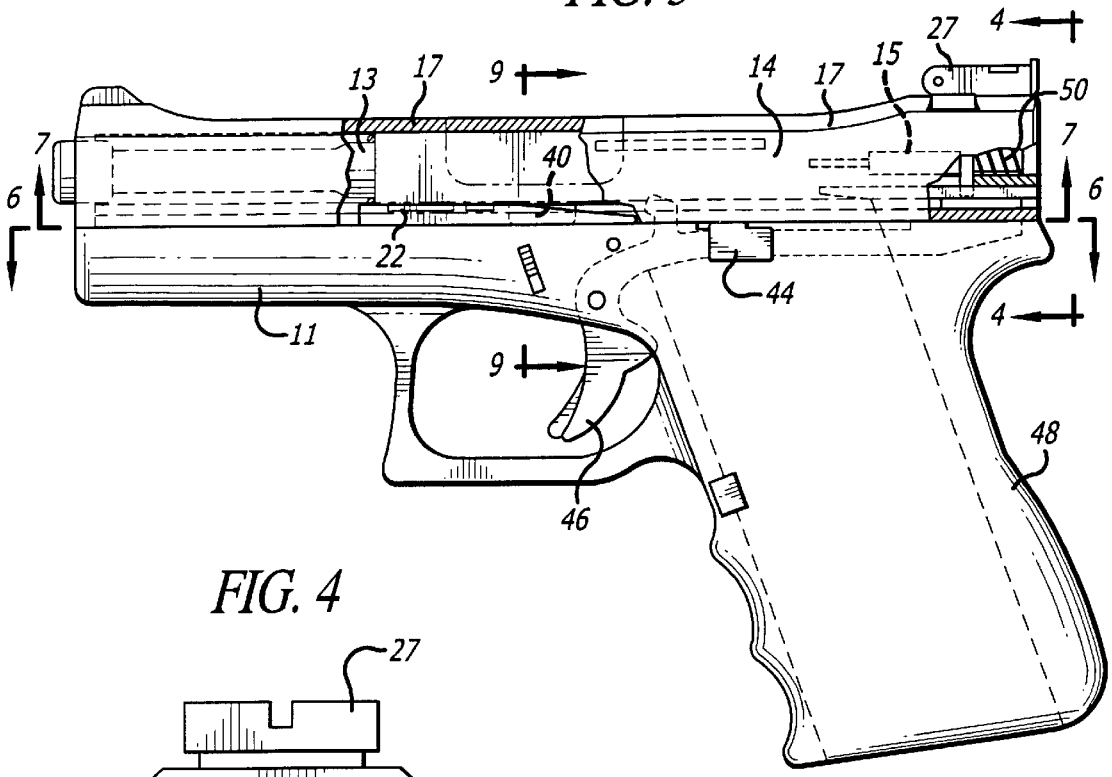
FIG. 4
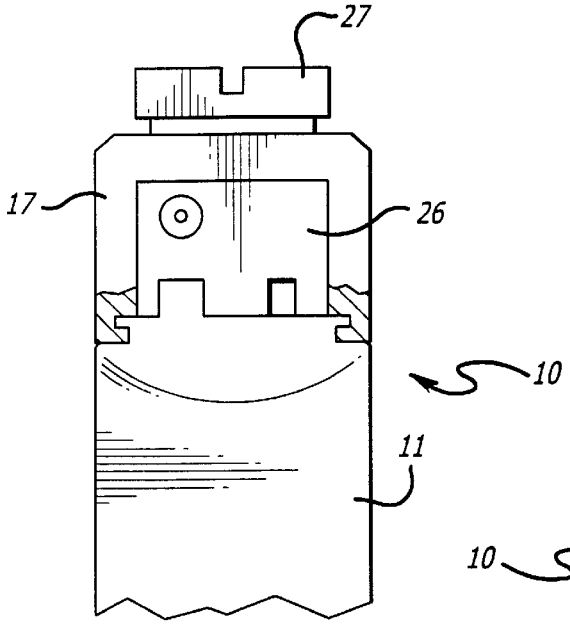
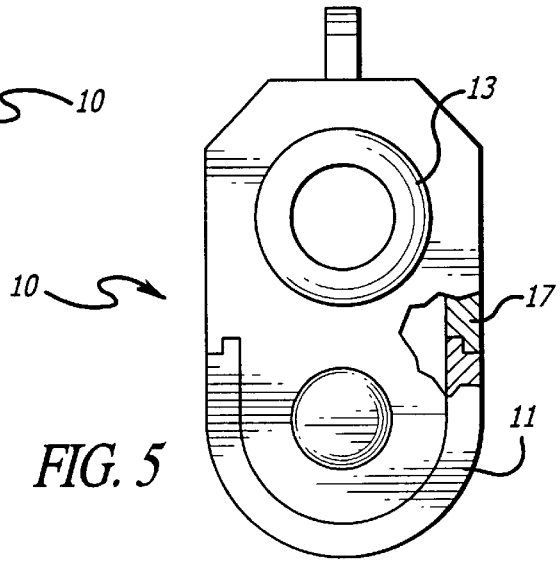
FIG. 5

PISTOL CALIBER CONVERSION ASSEMBLY

Priority Claimed on Ser. No. 60-259,940 filed Jan. 2, 2001 now abandoned.

BACKGROUND OF THE INVENTION

1. Field of the Invention

The present invention relates to the field of conversion assemblies for permitting the interchange of a variety of caliber ammunition to be shot and, more particularly, to a slide assembly having lightweight characteristics derived from use of selected materials and adapted to be selectively machined to remove excess material mass.

2. Brief Description of the Prior Art

In the past, problems and difficulties have been encountered in the pistol armament field which stem from excessive wear between sliding components. This is especially a problem in designing and manufacturing caliber conversion kits so that a lesser caliber ammunition can be fired in a pistol designed to shoot larger center fire ammunition. Almost all caliber conversion kits are composed of light-weight material such as aluminum. Unfortunately, this material is softer than steel which is the material that most larger caliber pistol components are made of. For example, the caliber conversion slide assembly carrying the barrel, bolt, firing pin assembly, extractor, ejector, etc. is of a soft material which does not allow a "Lock Open" feature because of excessive wear that is created when a "Slide Top Lever" engages with the aluminum slide. The "Lock Open" feature is when the slide assembly remains open after the last round has been fired. Therefore, a need has existed to provide a heat treated insert capable of withstanding the wear of constant engagement between the slide stop lever and the lock open insert.

Furthermore, prior slide assemblies, including the slide and bolt made as a one-piece construction resulting in a massive use of material, is heavy. Therefore, the manufacturer cannot elect to employ different materials for the slide and the bolt. For example, conventional slide assemblies cannot make the slide of plastic with either an aluminum or steel bolt. Thus, a need has existed to provide a slide assembly whereby different materials can be employed for various components and wherein selected components may be milled or machined to remove unnecessary material in order to lighten the final slide assembly.

SUMMARY OF THE INVENTION

Accordingly, the above problems and difficulties are avoided by the present invention which provides a pistol frame having a movable slide assembly carried thereon by a groove and rail arrangement. The slide assembly includes a stationary bolt and movable barrel having a recoil mechanism that includes a guide rod with an expansion spring disposed between the bolt and the end of the slide assembly. A lock and release latch mechanism is cooperatively disposed between the frame and the slide assembly that automatically releases the lock to its open position upon ejection of a last round of ammunition. This latter mechanism includes a stop lever operable on the frame to selectively engage and disengage with an insert carried on the slide assembly. The slide assembly has a slide housing and a barrel/bolt combination composed of different materials permitting machining so as to remove unnecessary material mass.

Therefore, it is among the primary objects of the present invention to provide a light-weight slide assembly for a pistol having a Lock Open Insert capable of withstanding excessive wear when a Slide Stop Lever engages therewith.

Another object resides in providing a slide assembly which includes components such as a slide and a bolt which are composed of different materials and which may be readily machined to remove unnecessary material mass so as to lighten the overall assembly.

A further object resides in a novel light-weight slide assembly for a pistol which is able to shoot inexpensive 22 Long Rifle ammunition that were designed to shoot larger center fire ammunition such as 9 mm; 0.40 S and W; 10 mm; and 0.45 auto ammunition.

Yet another object of the invention resides in a caliber conversion kit having a light-weight slide assembly assembled with a modular or separate "slide" and "bolt" whereby a two piece design is provided permitting unneeded material to be machined from the slide from under the bolt and further which permits the material composition of the slide and the bolt to be different.

BRIEF DESCRIPTION OF DRAWINGS

The features of the present invention which are believed to be novel are set forth with particularity in the appended claims. The present invention, both as to its organization and manner of operation, together with further objects and advantages thereof, may best be understood with reference to the following description taken in connection with the accompanying drawings in which:

FIG. 3 is an enlarged side elevation view, partly in section, illustrating the barrel and slide assembly;

FIG. 4 is a back end elevational view of the pistol shown in FIG. 3 as taken in the direction of arrows 4—4 thereof;

FIG. 5 is a front end elevational view taken in the direction of arrows 5—5 of FIG. 3;

DESCRIPTION OF PREFERRED EMBODIMENT

Figures 1, 2:
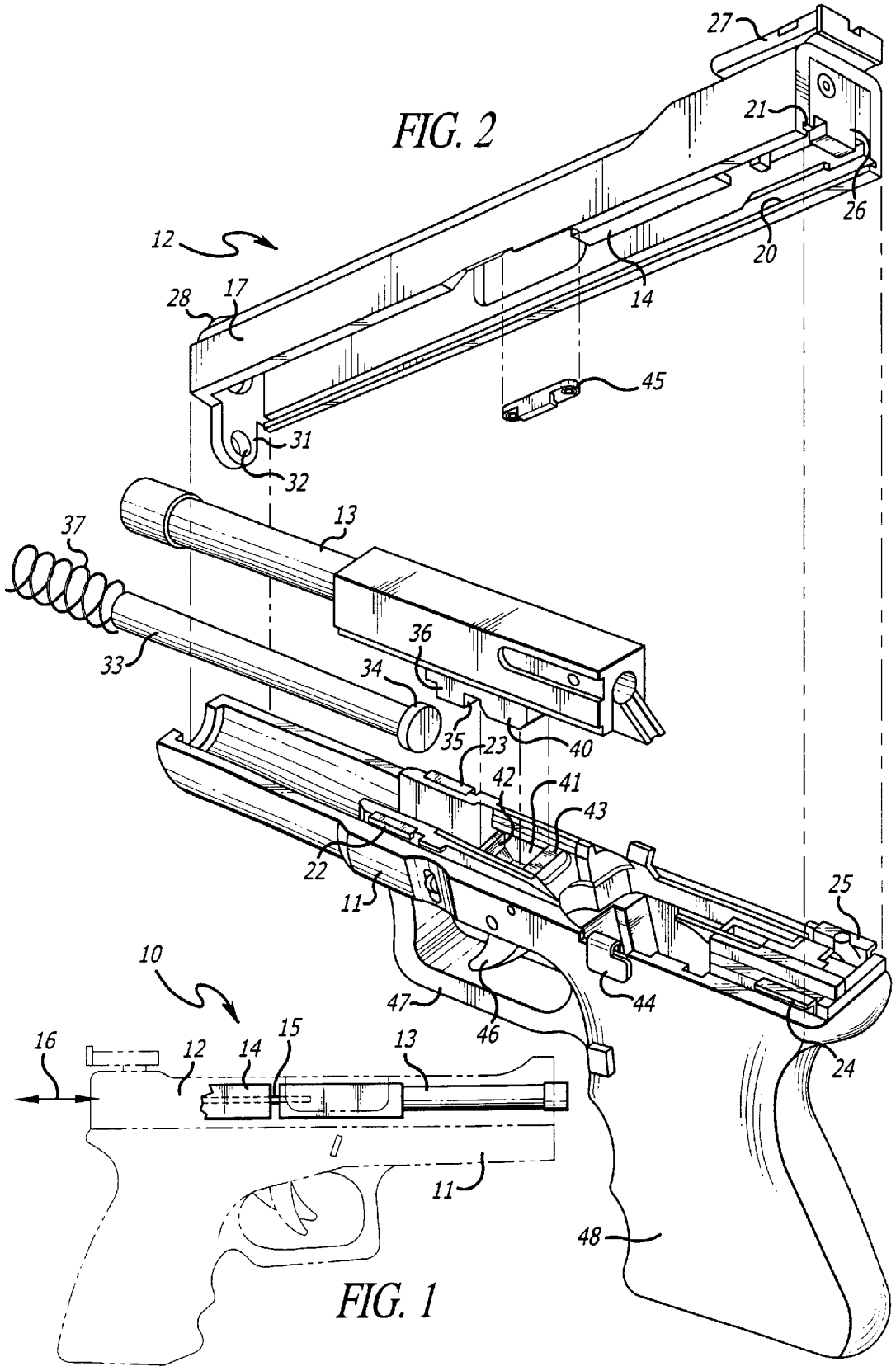
FIG. 1 is a side elevational view of a pistol having a conversion assembly for accommodating ammunition of different calibers.
FIG. 2 is an exploded view of the piston caliber conversion assembly shown in FIG. 1.

Referring to FIG. 1, a pistol incorporating the present invention is illustrated in the general direction of arrow 10 which includes a pistol frame 11, slidably supporting a slide assembly 12, which includes a barrel 13 and a bolt 14 having a firing pin 15. The slide assembly 12 is adapted to move rectilinearly on the pistol frame 11 in accordance with the arrow 16.

Referring in detail to FIG. 2, it can be seen that the slide assembly 12 includes an elongated slide 17 having an internal cavity which is occupied by the barrel 13, which further includes a pair of opposing track grooves 20 and 21 for accommodating rails 22 and 23 carried on the midsection of the pistol frame 11 and rear rails 24 and 25 carried at the rear or back end of the pistol frame 11. The rails are adapted to be introduced into the grooves 20 and 21 via a retainer 26 which holds the rear of the slide assembly. The slide 17 further includes a rear sight 27 as well as a front sight 28. The bolt 14 is indicated as being within the channel cavity of the slide 17 immediately behind the barrel 13. However, the firing pin 15, firing pin block and the extractor spring bias pin are not illustrated in FIG. 2. The extreme front end of the slide 17 includes a downwardly depending projection 31 having a aperture 32 into which the end of a rod 33 is inserted which forms a part of the recoil mechanism for the barrel 13. It is noted that the rod 33 includes a circular flange 34 which fits into a slot 35 immediately behind a block 36. One end of a spring 37 bears against a notch in the block 36, while the opposite end of the spring 37 bears against the opposing surface of projection 31 to complete the recoil mechanism for the barrel. Immediately behind the slot 35 is a latch block 40 which is insertably received into a latch well 41 in the pistol frame 11. The well 41 is defined between elements 42 and 43 fixly located in the pistol frame 11.

It is of importance to note that the pistol frame 11 further includes a slide stop lever 44 which is intended to engage with a steel insert 45 carried on the side of the slide 17. The "Lock Open" feature is when the slide remains open after the last round of ammunition has been fired. The "Lock Open" insert 45 is a heat treated steel insert designed to withstand the wear of the constant engagement between the slide stop lever 44 and the lock open insert 45. This "Lock Open" feature is not found in any other conversion kit.

It is also to be understood that the slide 17 is composed of aluminum material which is anodized so as to be of light-weight. Contrary to conventional practice the slide 17 and the bolt 14 are manufactured and machined individually so as to remove any excess mass material in order to lighten the weight of the slide assembly 12. The bolt 14 is preferably composed of aluminum with a breech face included.

Figure 7:
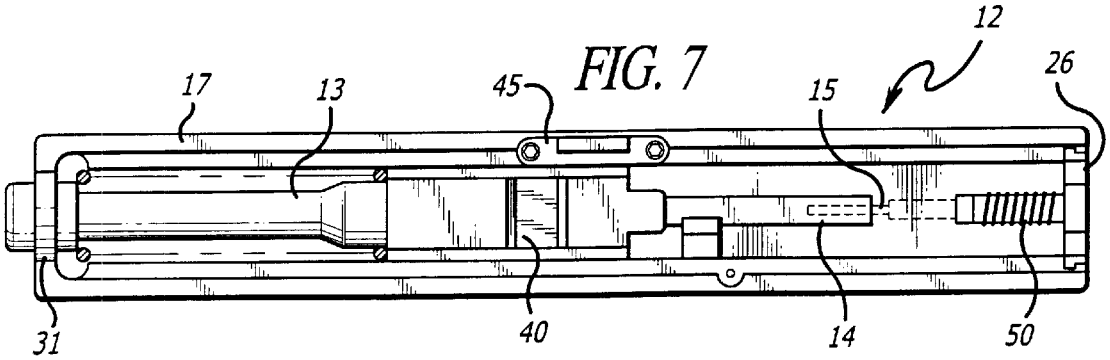
FIG. 7 is a longitudinal cross-sectional view of the pistol shown in FIG. 3 as taken in the direction of arrows 7—7 thereof illustrating the components in the slide.
Figure 8:
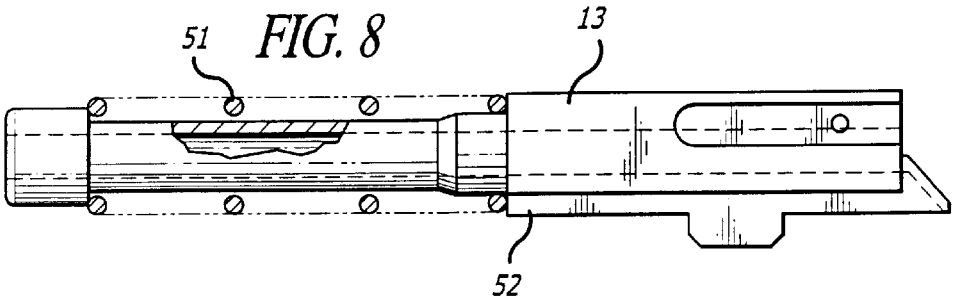
FIG. 8 is a side elevational view of the barrel mounted in the slide shown in FIG. 7 with one version of spring return.
Figure 10:
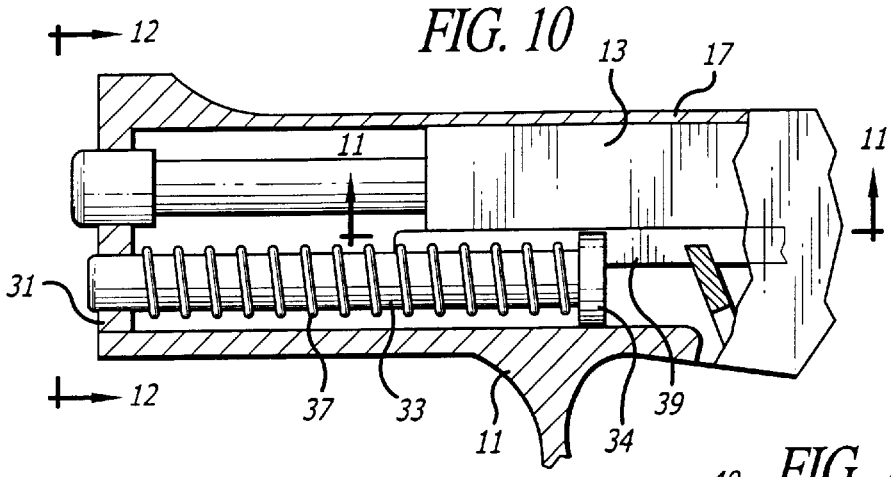
FIGS. 10 and 11 are fragmentary sectional views of the slide and a top elevational view of the barrel illustrating a preferred version of spring biased barrel return.

The recoil assembly shown in FIG. 2 is described more completely further on in connection with FIG. 10 and is the preferred construction. However, it is to be understood that an alternative recoil assembly is illustrated in FIGS. 3, 7 and 8 respectively.

To complete the pistol, a trigger 46 is included as well as a trigger guard 47 forming a part of the pistol frame. Also, an ammunition chamber is included within the handle 48 for holding a supply of ammunition preparatory for introduction into the ammunition chamber in the slide assembly 12.

Referring now to FIG. 3, it can be seen that the slide assembly is carried on the pistol frame 11 so that the barrel 13 is in the foreword portion of the slide 17 while the bolt 14 occupies the rear end of the slide assembly. The firing pin spring and mount in the bolt 14 is indicated by numeral 50. The insert 45 is indicated via the broken-way portion of the slide 17 while the release latch 44 is illustrated in its non-lock position.

FIGS. 4 and 5 illustrate the rear and front of the pistol 10 as taken in the direction of the respective arrows in FIG. 3.

Referring now to FIG. 7, it can be seen that the insert 45 is carried on the slide 17 and that when the slide 17 is placed on the pistol frame 11, the insert will engage with the release latch 44. Shown in FIG. 6 as well, the latch block 40 is in the well so that the slide and pistol frame are secured together, permitting only the slide to move on the rails 22–25 inclusive in the respective grooves 20 and 21.

Figure 9:
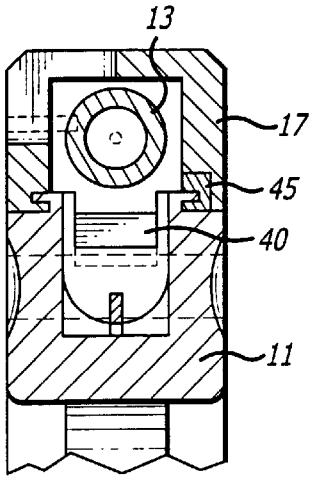
FIG. 9 is a transverse cross-sectional view of the slide and pistol shown in FIG. 3 as taken in the direction of arrows 9—9 thereof.

The firing pin assembly bears against a sear which cocks the firing mechanism preparatory for release by the trigger in order to fire a round in the firing chamber. The rail and groove arrangement is shown more clearly in FIG. 9.

Figure 6:
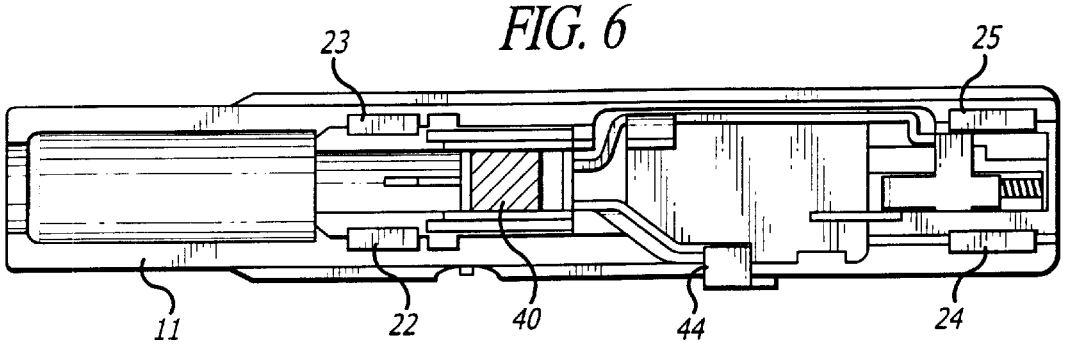
FIG. 6 is a longitudinal cross sectional view of the pistol taken along arrows 6—6 of FIG. 3 illustrating components mounted in the pistol.

An alternative recoil assembly is illustrated in FIGS. 3, 6, and 8, wherein a recoil spring 51 is placed around the barrel and at one end engaging a shoulder 52 while the other end butts against the ring 31 of the slide. The slide can move back and forth in accordance with arrow 16 while the barrel 13 remains stationary with the pistol frame 11.

Figure 11:
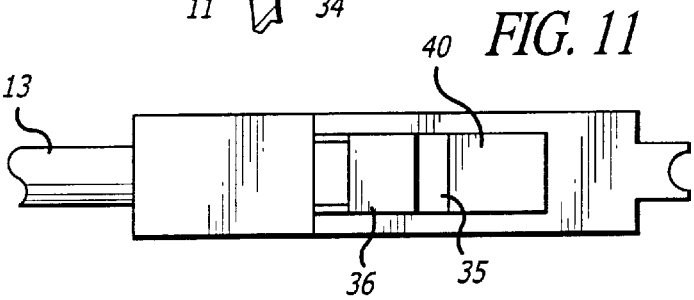
Figure 12:
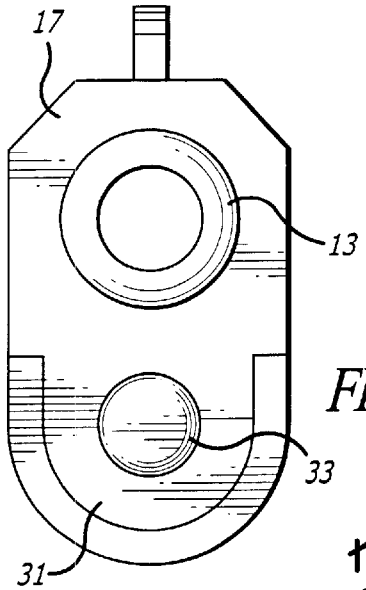
FIG. 12 is a front elevational view of the slide shown in FIG. 10 taken in the direction of arrows 12—12 thereof.

Referring now in detail to FIGS. 10–12 inclusive, the preferred recoil mechanism is indicated which is employed in the embodiment shown in FIG. 2. The rod 33 is mounted on the pistol frame 11 by means of the flange 34 abutting against a shoulder 39 on the block 36. The spring 37 is placed about the rod 33 and its forward end butts against the downwardly depending element 31 when the front end of the rod 33 projects through hole 32.

Figure 13:
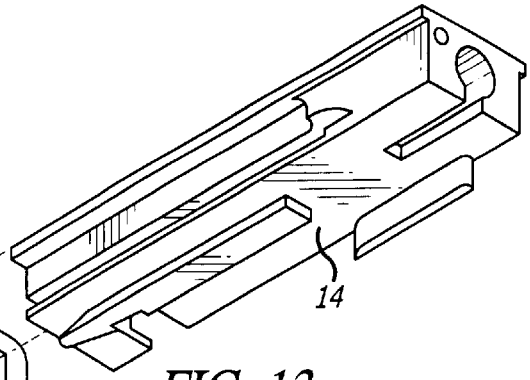
FIG. 13 is an exploded perspective view of components in the slide.
Figure 14:
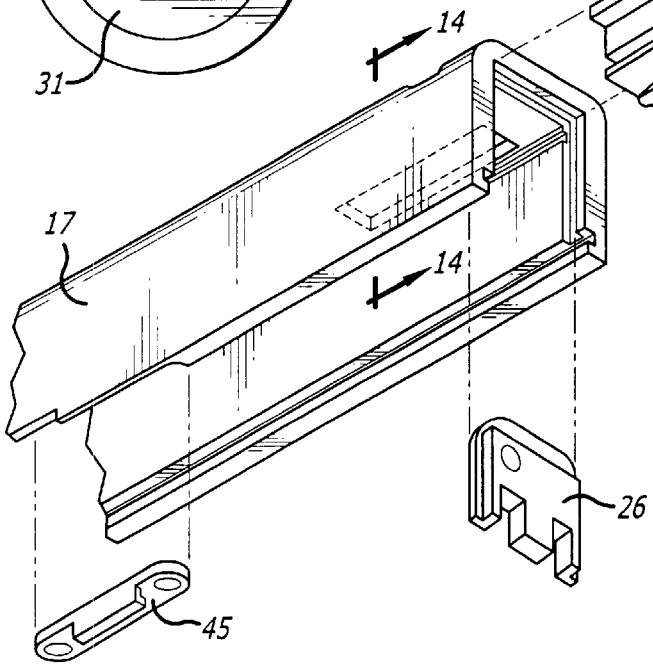
FIG. 14 is a transverse cross-sectional view of the slide taken in the direction of arrows 14—14 of FIG. 13.
Figure 14:
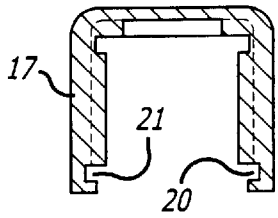

Referring now in detail to FIGS. 13 and 14, it can be seen that the slide 17 has an elongated internal channel into which the bolt 14 is placed and that the insert 45 is carried along the side edge of the slide. The bolt may readily be machined in order to remove excess material mass in order to lighten the bolt. The barrel 13 may also be machined in order to remove material mass so that the slide assembly is light in weight and yet the choice of material between the insert and the latch release 44 permits longevity of usage since material fatigue and wear are reduced.

In view of the foregoing, it can be seen that the heat-treated insert engages the cut-out in the slide to keep the slide open. The bolt and the rails are fabricated separately and are not integrally formed with the slide. This allows removal of extra material in the slide in the form of pockets. The novel construction permits excess to areas of the slide which are normally closed or interfere with the integral bolts. The slide moves rearward and the barrel is part of the stop or rearward movement because of the projection block in the well 41. "Release" is effected by pushing downward and the last bullet follower pushes the release latch 44 upward to keep the slide open. This construction makes the pistol easier to load. FIGS. 8 and 10 illustrate a recoil mechanism which is more conveniently cleanable by means of spring removal and then the barrel is easy to extract.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. In a pistol caliber conversion assembly for use with a pistol frame having an ammunition housing occupied by multiple rounds of ammunition; a slide housing slidably mounted thereon, the improvement which comprises:

a substitute slide housing composed of aluminum and having a movable barrel carried therein;

a steel insert secured to said substitute slide housing;

a guide rail arrangement cooperatively mounting said substitute slide housing on said pistol frame permitting rectilinear sliding positioning of said substitute slide housing on said pistol frame;

a latch mechanism carried on said pistol frame adjacent to said guide arrangement effective to selectively engage with said steel insert for releasably holding said substitute slide housing in an open position exposing said ammunition housing after ejection of a last round from the rounds of ammunition;

said latch mechanism selectively engageable with said steel insert whereby actuation of said latch mechanism selectively holds said substitute slide housing in said open position with respect to said pistol frame to expose said ammunition housing in response to firing and ejection of the last round of ammunition; and said insert and said latch mechanism are composed of steel and said barrel is composed of steel susceptible to being machined to reduce mass and therefore weight.

2. A pistol caliber conversion assembly for use with a pistol comprising;

a pistol frame having multiple rounds of ammunition of a given caliber in an ammunition housing;

an interchangeable slide assembly reciprocally carried on said pistol frame including a substitute slide housing composed of aluminum and having a stationary block and barrel combination movable as a unit between a forward position and a reset position within said substitute slide housing;

recoil means resiliently disposed between said substitute slide housing and said pistol frame normally urging said substitute slide housing into said forward position;

a lock mechanism operatively connectable between said substitute slide housing and said pistol frame to set said substitute slide housing into an open position upon ejection of a last round of ammunition from said ammunition housing;

said block and barrel composed of a steel material permitting machining away of excess material to reduce weight while maintaining sufficient strength and mass to handle firing loads;

said recoil means includes a guide rod carried on said pistol frame having a rear flanged end and a forward end;

said substitute slide housing having a downwardly depending projection with a pair of spaced-apart openings for slidably receiving said barrel and said forward end of said guide rod;

said barrel provided with a downwardly depending block;

a resilient coil spring included in said recoil means carried about said guide rod and said coil spring provided with a front end bearing against said projection and a rear end bearing against said flanged end; and said lock mechanism includes an insert composed of steel secured on said slide housing, and a latch composed of steel carried on said pistol frame selectively engageable with said insert for releasably holding said substitute slide housing in said open position exposing said ammunition housing in response to ejection of said last round of ammunition from said ammunition housing.

* * * * *